US006776312B2

(12) United States Patent
Masuzzo et al.

(10) Patent No.: US 6,776,312 B2
(45) Date of Patent: Aug. 17, 2004

(54) ACTUATING HEAD OF A DOUBLE-ACTING PUMP FOR EJECTING A PRODUCT FROM A CONTAINER

(75) Inventors: Ettore Masuzzo, Eppstein (DE); Stefan Christ, Hochheim (DE)

(73) Assignee: Aero Pump GmbH, Zerstäuberpumpen, Hochheim/Main (DE)

( * ) Notice: Subject to any disclaimer, the term of this patent is extended or adjusted under 35 U.S.C. 154(b) by 17 days.

(21) Appl. No.: 10/340,872

(22) Filed: Jan. 10, 2003

(65) Prior Publication Data

US 2003/0155379 A1 Aug. 21, 2003

(30) Foreign Application Priority Data

Jan. 10, 2002 (DE) ..... 102 00 595

(51) Int. Cl.[7] ..... B67D 5/40

(52) U.S. Cl. ..... 222/321.7; 222/380; 222/494; 239/333

(58) Field of Search ..... 222/321.1, 321.7, 222/321.9, 380, 383.1, 494; 239/333

(56) References Cited

U.S. PATENT DOCUMENTS

| | | | | |
|---|---|---|---|---|
| 4,558,821 A | | 12/1985 | Tada et al. | 239/333 |
| 4,678,122 A | * | 7/1987 | Riglietti | 239/333 |
| 5,024,355 A | | 6/1991 | Jouillat et al. | 222/162 |
| 5,181,658 A | | 1/1993 | Behar | 239/493 |
| 5,186,368 A | | 2/1993 | Garcia | 222/490 |
| 5,769,325 A | | 6/1998 | Jouillat et al. | 239/337 |
| 6,095,376 A | | 8/2000 | Hennemann et al. | 222/190 |
| 6,685,109 B2 | * | 2/2004 | Py | 239/461 |

FOREIGN PATENT DOCUMENTS

| | | |
|---|---|---|
| EP | 0 032 541 A2 | 11/1980 |
| FR | 2 622 478 A1 | 11/1987 |
| FR | 2 635 08 4 A1 | 8/1988 |
| GB | 917135 A | 6/1961 |
| GB | 1 586 170 A | 9/1977 |

* cited by examiner

*Primary Examiner*—Joseph A. Kaufman
(74) *Attorney, Agent, or Firm*—Friedrich Kueffner

(57) ABSTRACT

A actuating head of a double-acting or lift and force pump for ejecting a product from a container includes an outlet duct leading to an ejection opening, wherein a valve closing piece is arranged in the outlet duct. Together with the outlet duct, the valve closing piece forms a check valve which, when the actuating head is actuated, is opened by the pressure of the product and allows the product to flow into a space defined by the inner side of the outlet duct and the circumference of the valve closing piece. This space is connected through at least one transverse groove to the ejection opening. The valve closing piece is elastically deformed by the product pressure when the actuating head is actuated and opens the check valve. The valve closing piece borders against the transverse groove and rests with its rear side against a radially inwardly protruding shoulder of the outlet duct. The rear side of the valve closing piece is provided with at least one radial groove and the portion of the outlet duct located on the rear side of the valve closing piece can be connected through the at least one radial groove to the space, wherein the valve closing piece has a circumferential sealing lip which releases the flow of the product as a result of the product pressure when the actuating head is actuated.

5 Claims, 5 Drawing Sheets

ACTUATING HEAD OF A DOUBLE-ACTING PUMP FOR EJECTING A PRODUCT FROM A CONTAINER

BACKGROUND OF THE INVENTION

1. Field of the Invention

The present invention relates to an actuating head of a double-acting or lift and force pump for ejecting a product from a container. The actuating head includes an outlet duct leading to an ejection opening, wherein a valve closing piece is arranged in the outlet duct. Together with the outlet duct, the valve closing piece forms a check valve which, when the actuating head is actuated, is opened by the pressure of the product against the force of a spring and allows the product to flow into a space defined by the inner side of the outlet duct and the circumference of the valve closing piece. This space is connected through at least one transverse groove to the ejection opening. The valve closing piece is of a rubber-elastic material which is elastically deformed by the product pressure when the actuating head is actuated and opens the check valve, wherein the valve closing piece borders with its end face against the at least one transverse groove and rests with its rear side against a radially inwardly protruding shoulder of the outlet duct.

2. Description of the Related Art

An actuating head of the above-described type is disclosed in DE 694 09 380 T2. In this actuating head, the valve closing piece is axially compressed by the fluid pressure when the actuating head is actuated and the valve closing piece is lifted by the radially inwardly protruding shoulder of the outlet duct. Lifting of the valve closing piece by the radially inwardly protruding shoulder requires a high actuating pressure and a high actuating force. Consequently, when the pump is used for the first time, the actuating head must be actuated several times in order to build up the required high pressure. This is cumbersome. A high actuating force may also have to be applied by the user.

DE 26 44 321 A shows an actuating head in which a fitting piece is arranged between the ejection opening and the valve closing piece, wherein the fitting piece covers the transverse grooves leading to the ejection opening. The valve closing piece rests on the fitting piece through a restoring spring. The valve closing piece is cup-shaped and is of a hard material. When the head is actuated, the valve closing piece is displaced from a closed position in the outlet duct in which it sealingly rests against the inner side of the outlet duct into the open position against the force of the restoring spring. During this displacement, the valve closing piece slides along axial ribs formed on the inner side of the outlet duct. The ribs define grooves through which the product can flow to the transverse grooves. The restoring spring protrudes into the interior space of the cup-shaped valve closing piece. Accordingly, the space between the ejection opening and the valve closing piece in the closed position has a relatively large volume. A correspondingly large product quantity remains in this space after the actuation of the head. Moreover, ambient air is drawn into the space during the return movement of the valve closing member into the closed position. Consequently, the product quantity remaining in the space may become contaminated. This may lead to significant health problems if the product is a foodstuff or a medicament, for example, a medicament which is applied onto the skin, for example, a wound, of a patient or which is to be sprayed into the mouth of a patient.

SUMMARY OF THE INVENTION

It is the primary object of the present invention to provide an actuating head of the above-described type in which the actuating pressure required for opening the check valve is lower.

In accordance with the present invention, the rear side of the valve closing piece is provided with at least one radial groove and the portion of the outlet duct located on the rear side of the valve closing piece can be connected through the at least one radial groove to the space, wherein the valve closing piece has a circumferential sealing lip which releases the flow of the product as a result of the product pressure when the actuating head is actuated.

As a result of the configuration according to the present invention, it is not necessary that the entire valve closing piece is being deformed. Rather, only the sealing lip of the valve closing piece has to be deformed. This can be achieved with low pressure.

In contrast to the actuating head according to DE 26 44 321 A, a separate restoring spring for the valve closing piece and a fitting piece between the restoring spring and the ejection opening for covering the at least one transverse groove are not required. As a result, not only the manufacture of the actuating head is less complicated, but the distance between the valve closing piece and the outlet opening in the closed position of the valve closing piece and, consequently the volume of the space therebetween, can be reduced. As a result, after actuating the actuating head, a smaller amount of product remains in the space in which the product could be contaminated, so that the danger of health problems is also reduced.

In accordance with a preferred feature, the valve closing piece elastically rests with its rear side against the radially inwardly protruding shoulder of the outlet duct. This makes it unnecessary to displace the valve closing piece and to provide space for making the movement possible. The space between the valve closing piece and the ejection opening can then also be smaller.

In accordance with a preferred feature, the valve closing piece is of solid material. This eliminates a hollow space in the valve closing piece.

In addition, the outlet duct may extend through a pipe which laterally protrudes beyond the circumference of the container, wherein the ejection opening is provided in the form of a nozzle at the free end of the pipe. This pipe makes it possible to place the ejection opening close to the location where the product is intended to impinge, for example, into the mouth of a patient, without being impeded by the container, so that the danger of a contamination of the product as it travels from the ejection opening to the application location is essentially avoided.

The sealing lip preferably surrounds the valve closing piece approximately in the axial middle thereof. This reduces the space between the sealing lip and the ejection opening further. The remaining product quantity which remains in the space and could come into contact with the ambient air is then also reduced.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
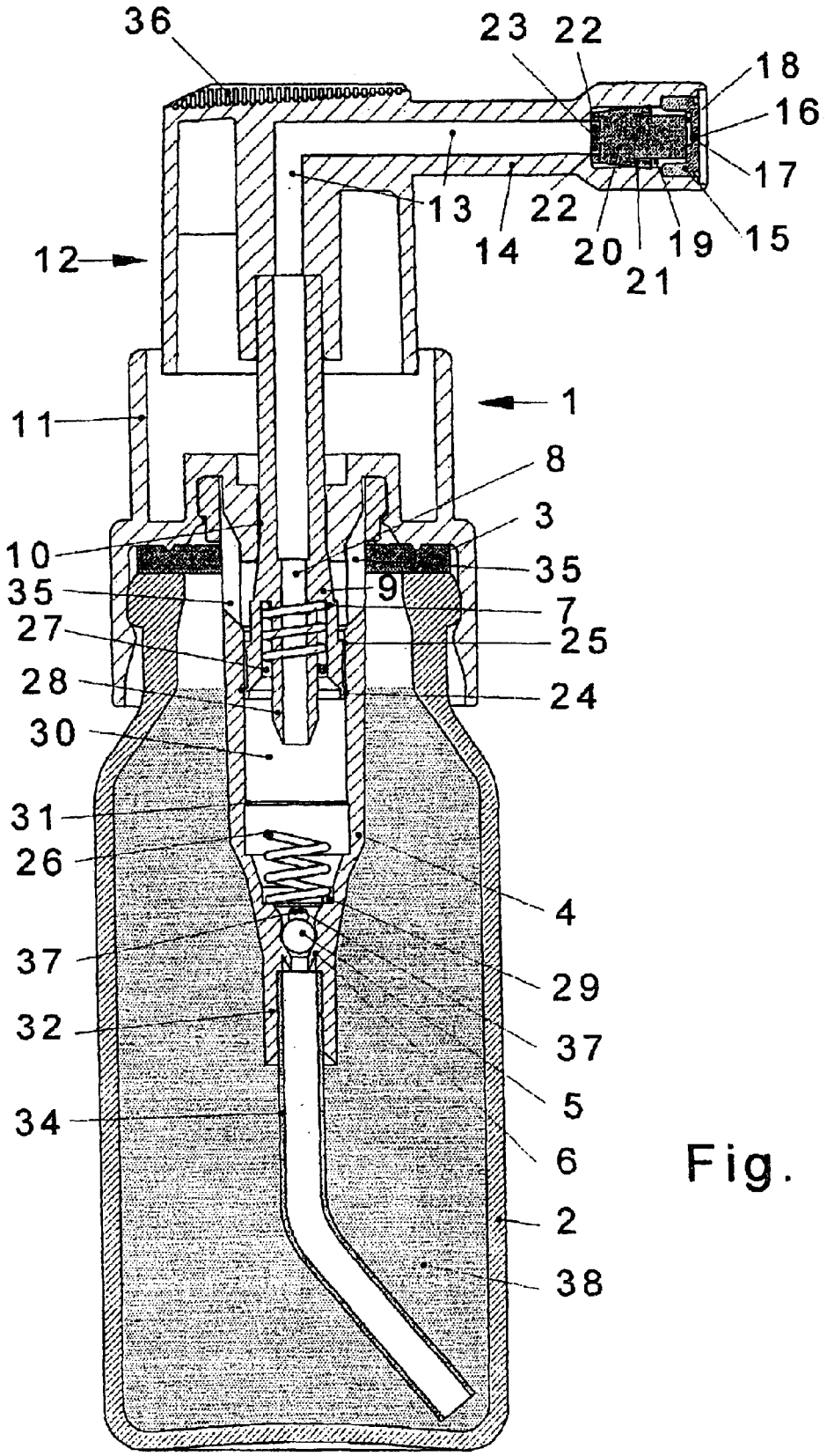
FIG. 1 is a sectional view of a double-acting pump with an actuating head according to the present invention mounted on a container filled with a product to be dispensed, before the first actuation of the double-acting pump by means of the actuating head.

The double-acting pump 1 illustrated in the drawing is tightly mounted on the rim of an opening of a container 2 through a sealing ring disc 3 arranged therebetween. The double-acting pump 1 has a hollow-cylindrical housing 4 whose lower end can be closed through a check valve with a valve closing ball 5. In the lower position illustrated in FIG. 1, the valve closing ball 5 rests tightly on a valve seat 6. A hollow-cylindrical piston 7 is axially displaceable in the housing 4 in a sealing manner against the inner side of the housing 4. The bore 8 of the piston 7 continues in a hollow piston rod 9 integrally formed with the piston 7. The piston rod 9 is displaceable in an opening 10 of an upper closing cap 11 so as to be sealed from the housing 4 and the container 2.

An actuating head 12 of the double-acting pump 1 is sealingly and tightly placed on the free end of the piston rod 9 which protrudes out of the housing 4. Extending through the actuating head 12 is an outlet duct 13 which continues through a bore 8 which, in turn, continues through a pipe 14 which protrudes by a relatively great distance beyond the outer side of the container. An approximately cup-shaped insert 15 is tightly mounted at the free end of the pipe 14. The insert 15 has in its bottom an ejection opening 16 which acts as a nozzle. A turbulence chamber 17 leads into the outlet opening 16 on the inner side of the insert bottom. The turbulence chamber 17 is in communication with an annular space 19 through at least one transverse groove 18 formed on the inner side of the bottom of the insert 15. This annular space 19 is defined by the inner side of the outlet duct 13 in the pipe 14, on the one hand, and, on the other hand, by a solid valve closing piece 20 which interacts with the inner side of the outlet duct 13 in the pipe 14 as a check valve. The valve closing piece 20 is of a rubber-elastic material, e.g. an elastomer, and has a cylindrical body which approximately in its axial middle is surrounded by a sealing lip 21. The sealing lip 21 rests tightly against the inner side of the outlet duct 13 in the annular space 19 as a result of the spring force caused by its own elasticity. The end face of the valve closing piece 20 covers the at least one transverse groove 18 with the exception of a small opening at the radial outer end of the at least one transverse groove 18. The rear side of the valve closing piece rests elastically with radial ribs which define radial grooves therebetween against a radially inwardly protruding shoulder 23 of the outlet duct 13. The portion of the outlet duct 13 located on the rear side of the valve closing piece 20 can be connected to the annular space 19 through the grooves 22. If the cross-section of the groove is sufficiently large, only one groove may be sufficient.

Figure 3:
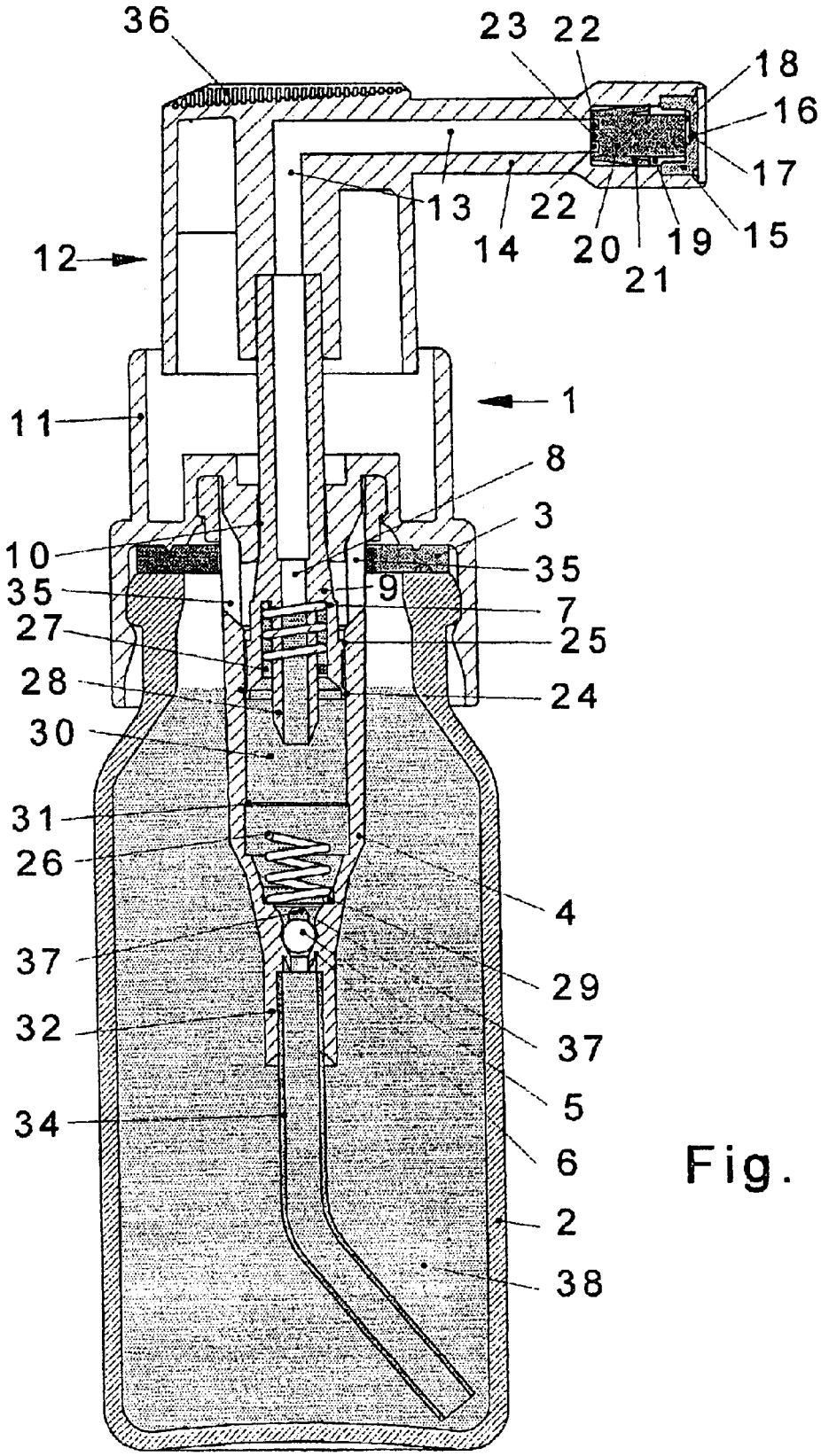
FIG. 3 is an axial sectional view of the double-acting pump and the container as shown in FIG. 1, at the end of the first suction stroke of the double-acting pump.
Figure 5:
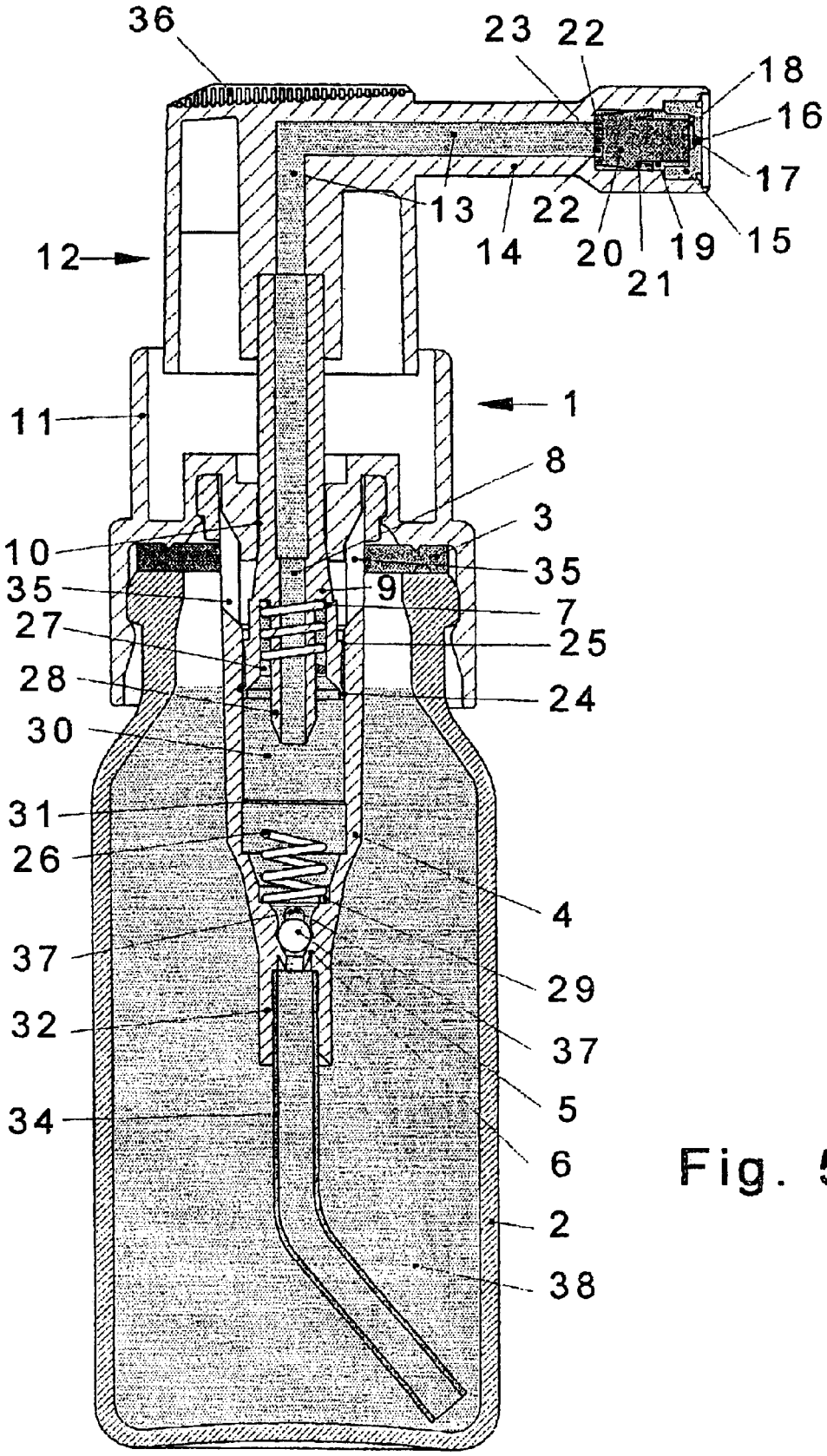
FIG. 5 shows the same axial sectional view as FIG. 3, however, at the end of a dispensing actuation.

In its non-actuated position shown in FIGS. 1, 3 and 5, the piston 7 rests tightly with a circumferential sealing lip 24 at its free end against the inner side of the housing 4. A collar 25 surrounding the piston 7 above the sealing lip 24 serves to guide the piston 7 during its movement, however, the collar 25 also provides for a play between the collar 25 and the inner side of the housing 4. A restoring spring 26, only partially illustrated in the drawing, rests in the piston 7 against the bottom of an annular space 27 which is defined by the outer wall of the piston 7 and a pipe piece 28, on the one hand, and against a shoulder 29 in the housing 4, on the other hand. The housing 4 has at the end of a pressure space 30 defined by the housing 4 a step 31, wherein the inner diameter of the housing 4 below the step 31 is slightly greater than the outer diameter of the sealing lip 24 of the piston 7. An immersion pipe 34 extending close to the bottom of the container 2 is fastened in a connecting piece 32 at the free lower end of the housing 4. In the upper end position of the piston 7 as shown in FIG. 1, the housing 4 is connected through lateral slots 35 to the inner space of the container 2 above the maximum filling level.

Figure 2:
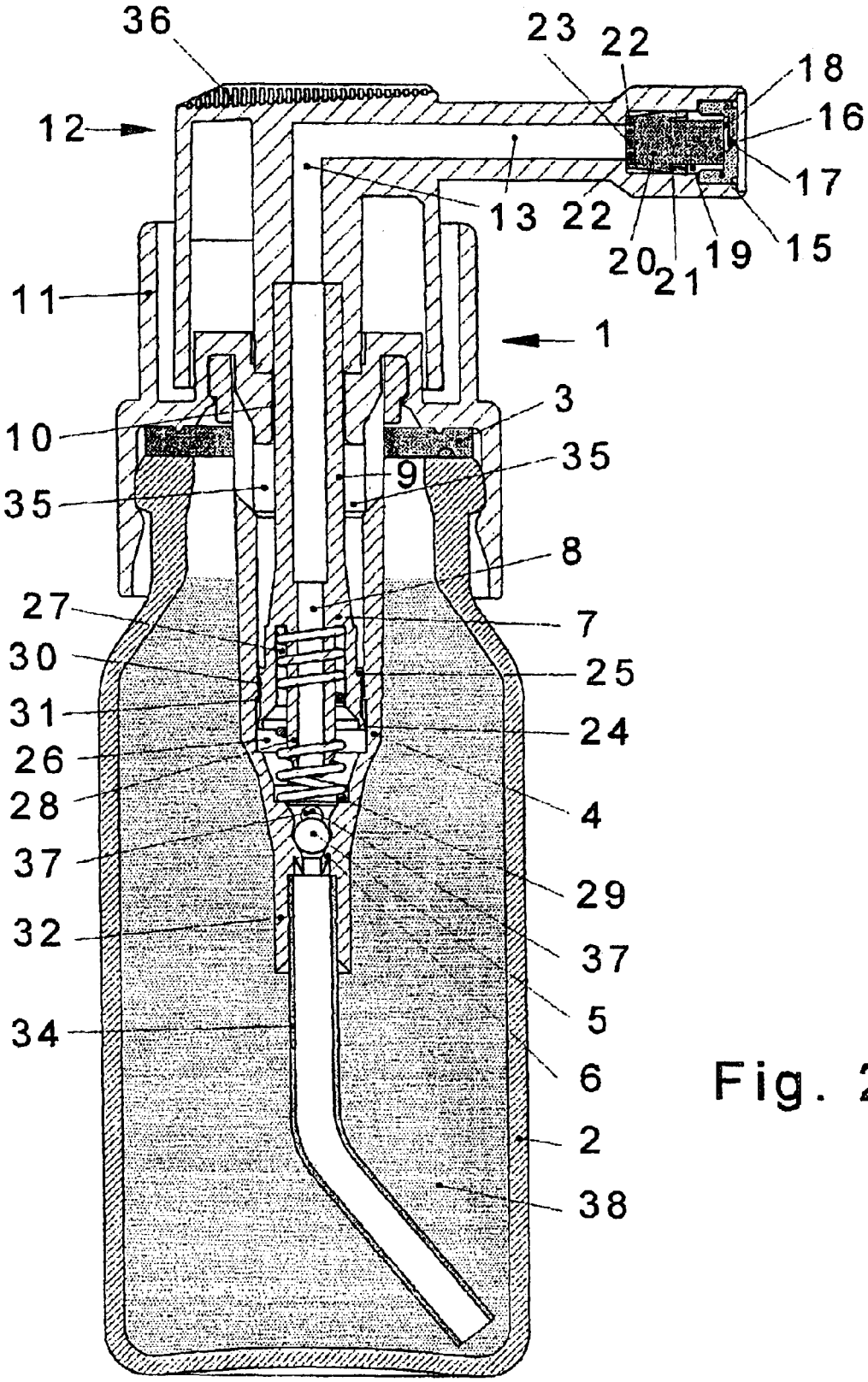
FIG. 2 is an axial sectional view of the double-acting pump and the container as shown in FIG. 1, after a first actuation of the double-acting pump by means of the actuating head.
Figure 4:
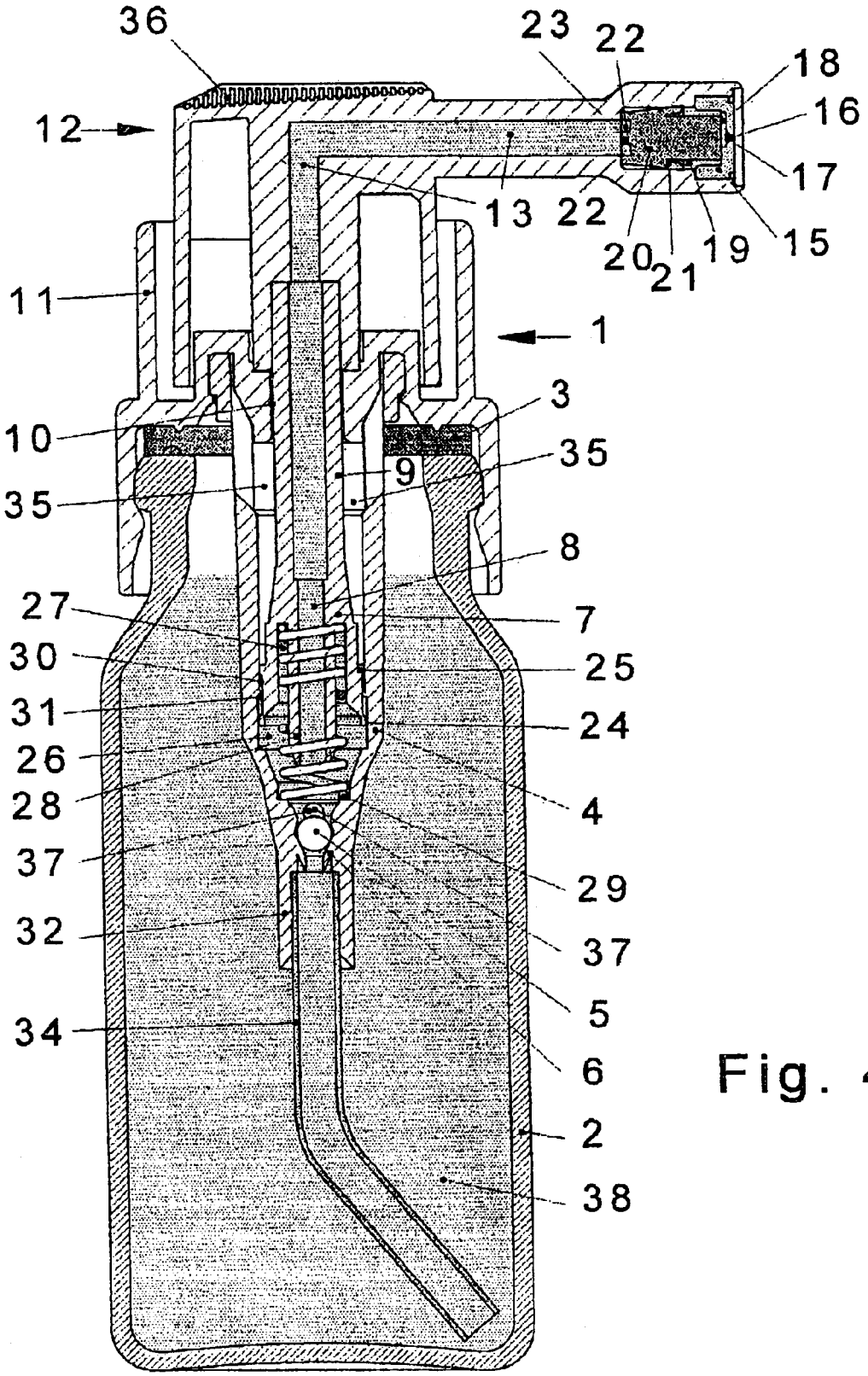
FIG. 4 is the same axial sectional view as FIG. 2, shown during a first dispensing actuation.

When the actuating head 12 is actuated for the first time by manually exerting a pressure on its upper side provided with a corrugation 36, the piston 7 moves against the force of the restoring spring 26 in the space 30 in the direction toward the check valve 5, 6 as seen in FIG. 2. The resulting air pressure in the space 30, in the bore 8 and in the outlet duct 13 holds the check valve 5, 6 closed, on the one hand, and, on the other hand, pushes the sealing lip 21 of the valve closing piece 20 toward the body thereof, so that the air contained in the space 30, in the bore 8, in the outlet duct 13 and in the annular space 19 can escape through the at least one transverse groove 18, the turbulence chamber 17 and the outlet openings 16. When the manual pressure is removed, the restoring spring 26 once again returns the piston 7 into its upper end position. The resulting negative pressure in the space 30, in the bore 8 and in the outlet duct 13 causes the valve closing ball 5 to be lifted from its seat 6 up to ribs 37 formed above the ball in the housing 4 and the sealing lip 21 of the valve closing piece 20 is pressed into the closed position against the inner side of the outlet duct 13. Simultaneously, the negative pressure causes a portion of the product 39 contained in the container 2 to be drawn out of the container 2 through the immersion pipe 34 and the now once again opening check valve 5, 6 into the space 30, as illustrated in FIG. 3. When the piston 7 is once again pushed down by means of the actuating head 12, the check valve 5, 6 is once again closed and the product is ejected out of the space 30 through the bore 8, the outlet duct 13, the once again opening check valve 13, 20 and the ejection opening 16, as shown in FIG. 4. The piston 7 may be pushed with its sealing lip 24 below the step 31. As soon as the sealing lip 24 has been moved past the step 31, the pressure in the space 30 is released along the sealing lip 24 and the collar 25 of the piston 7 and through the slots 35 into the space of the container 2 above the filling level of the product so that no further product 38 is ejected. Consequently, a precisely metered quantity of product is ejected during each actuation.

During the subsequent return movement of the piston 7 after the manual pressure on the actuating head 12 has been released, the piston 7 once again draws a portion of the product 38 from the container 2 into the space 30, as illustrated in FIG. 5.

When the piston 7 is pressed down once again from the position shown in FIG. 5 into the position shown in FIG. 4, a precisely metered product quantity is immediately ejected. The same is true during each further actuation until the container 2 is completely empty.

The valve closing piece 20 essentially does not change its axial position in the outlet duct 13 during each actuation of the double-acting pump 1; rather, the valve closing piece 20 always rests against the projection 23 and the ribs in the bottom of the insert 15 which define the at least one transverse groove 18. Also, because of the configuration of the valve closing piece 20 with the sealing lip 21 of rubber-elastic material, it is not necessary to provide a separate restoring spring for the valve closing piece 20 or a separate cover piece for the at least one transverse groove 18. Consequently, the annular space 19 can have a very small dimension, so that, after a portion of the product has been ejected, a very small produce rest which could be contaminated by air oxygen and/or bacteria entering through the outlet opening 16 and could pose health problems during the next actuation remains in the space between the sealing lip 21 and the outlet opening 16. Moreover, because of its tight contact with the inner side of the outlet duct 13 due to its own elasticity, the sealing lip 21 ensures a very secure sealing action, so that a penetration or "growing through" of bacteria or germs through the sealing gap into the product behind the valve closing piece 20 is safely prevented.

The long tube 14 additionally makes it possible to move the outlet opening 16 into the immediate vicinity of the desired location of application, for example, for spraying a medicament into the mouth of onto the skin of an ill patient, without the product having to travel a long distance through the air from the ejection opening 16 to the location of application.

The product 38 generally is a liquid which is to be sprayed. However, the product may also be a paste-like material.

While specific embodiments of the invention have been shown and described in detail to illustrate the inventive principles, it will be understood that the invention may be embodied otherwise without departing from such principles.

We claim:

1. An actuating head of a double-acting pump for ejecting a product from a container, the actuating head comprising an outlet duct leading to an ejection opening and a valve closing piece arranged in the outlet duct, the valve closing piece forming together with the outlet duct a check valve which, when the actuating head is actuated, is opened by pressure of the product against an elastic force so as to allow the product to flow into a space defined by an inner side of the outlet duct and a circumference of the valve closing piece, the space being connected through at least one transverse groove to the ejection opening, the valve closing piece being of a rubber-elastic material which is elastically deformed by the product pressure when the actuating head is actuated so as to open the check valve, the valve closing piece bordering with an end face thereof against the at least one transverse groove and resting with a rear side thereof against a radially inwardly protruding shoulder of the outlet duct, the rear side of the valve closing piece having at least one radial groove and a portion of the outlet duct located on the rear side of the valve closing piece being configured to be connected through the at least one radial groove to the space, and the valve closing piece having a circumferential sealing lip for producing the elastic force and for releasing the flow of the product as a result of the product pressure when the actuating head is actuated.

2. The actuating head according to claim 1, wherein the valve closing piece elastically rests with the rear side thereof against the radially inwardly protruding shoulder of the outlet duct.

3. The actuating head according to claim 1, wherein the valve closing piece is of solid material.

4. The actuating head according to claim 1, wherein the outlet duct extends through a tube which laterally protrudes beyond the circumference of the container, wherein a nozzle forming the ejection opening is arranged at a free end of the tube.

5. The actuating head according to claim 1, wherein the sealing lip surrounds the valve closing piece approximately at an axial middle of the valve closing piece.

* * * * *